US010470551B2

(12) United States Patent
Lin

(10) Patent No.: US 10,470,551 B2
(45) Date of Patent: Nov. 12, 2019

(54) TELESCOPIC LIPSTICK CASE

(71) Applicant: LIBO COSMETICS CO., LTD., Changhua County (TW)

(72) Inventor: Hsiao-Yun Lin, Changhua County (TW)

(73) Assignee: LIBO COSMETICS CO., LTD., Lukang Township, Changhua County (TW)

( * ) Notice: Subject to any disclaimer, the term of this patent is extended or adjusted under 35 U.S.C. 154(b) by 63 days.

(21) Appl. No.: 15/821,996

(22) Filed: Nov. 24, 2017

(65) Prior Publication Data

US 2018/0368554 A1 Dec. 27, 2018

Related U.S. Application Data

(60) Provisional application No. 62/523,978, filed on Jun. 23, 2017.

(51) Int. Cl.
*A45D 40/02* (2006.01)

(52) U.S. Cl.
CPC ..... *A45D 40/02* (2013.01)

(58) Field of Classification Search
CPC ..... A45D 40/02
USPC ..... 401/75
See application file for complete search history.

(56) References Cited

U.S. PATENT DOCUMENTS 2,263,632 A * 11/1941 Kendall ..... A45D 40/02 220/8
2,369,341 A * 2/1945 Donegan ..... A45D 40/02 401/83
3,044,612 A * 7/1962 Levine ..... A45D 40/02 401/82
5,172,993 A * 12/1992 Ackermann ..... A45D 40/04 401/69
2011/0123249 A1 5/2011 Delbove

FOREIGN PATENT DOCUMENTS

CN 105934178 A 9/2016
TW 342662 10/1998

OTHER PUBLICATIONS

Office Action issued in corresponding TW Application No. 107105310 dated Aug. 24, 2018, with partial English translation thereof, 10 pages.

* cited by examiner

*Primary Examiner* — Huyen D Le
(74) *Attorney, Agent, or Firm* — Muncy, Geissler, Olds & Lowe, P.C.

(57) ABSTRACT

A telescopic lipstick case for accommodating a lipstick includes a base, an inner body and an inner base. The inner body is fixed in the base. The inner base is cylindrically fitted in the inner body, wherein the inner base is axially movable with respect to the inner body between a first position and a second position.

11 Claims, 17 Drawing Sheets

TELESCOPIC LIPSTICK CASE

PRIORITY CLAIM AND CROSS-REFERENCE

This application claims priority of U.S. provisional application Ser. No. 62/523,978 filed on Jun. 23, 2017, which is incorporated by reference in its entirety.

TECHNICAL FIELD

The present disclosure relates to a telescopic lipstick case, and more particularly, to a telescopic lipstick case switchable between an extended state and a retracted state.

DISCUSSION OF THE BACKGROUND

A lipstick case is used to accommodate a lipstick. Conventionally, the lipstick case is designed to extract the lipstick when using the lipstick, and to retract the lipstick when it is no longer in use. Generally, the lipstick case is designed to have a compact size for the purpose of ease of carry. The tiny size, however, makes it difficult for the user to grip the lipstick case while using it.

This Background section is provided for background information only. The statements in this Background are not an admission that the subject matter disclosed in this section constitutes prior art to the present disclosure, and no part of this Background section may be used as an admission that any part of this application, including this Background section, constitutes prior art to the present disclosure.

SUMMARY

One aspect of the present disclosure provides a telescopic lipstick case with an extendable inner base.

A telescopic lipstick case for accommodating a lipstick includes a base, an inner body and an inner base. The inner body is fixed in the base. The inner base is cylindrically fitted in the inner body, wherein the inner base is axially movable with respect to the inner body between a first position and a second position.

In some embodiments, one of the inner body and the inner base includes a groove, and the other one of the inner body and the inner base includes a protrusion slidably received by the groove.

In some embodiments, the groove includes a first end and a second end.

In some embodiments, the inner base is downwardly movable with respect to the inner body, and the inner base is stoppable at the first position when the protrusion is restrained by the first end of the groove.

In some embodiments, the inner base is upwardly movable with respect to the inner body, and the inner base is stoppable at the second position when the protrusion is restrained by the second end of the groove.

In some embodiments, the telescopic lipstick case further includes a cap configured to cap the base.

In some embodiments, the inner base includes a bulge, and the cap includes a recess engageable with the bulge of the inner base.

In some embodiments, the bulge includes an annular bulge, and the recess includes an annular recess.

In some embodiments, at least one of the bulge and the cap is resilient such that the bulge is engageable with the recess.

In some embodiments, the inner base is moved downwardly to the first position by the cap when the cap is pushed in to the inner base.

In some embodiments, the inner base is moved upwardly to the second position by the cap when the cap is pulled out from the inner base.

In some embodiments, the telescopic lipstick case further includes a body, a rotary tube and a cup, wherein the body is fitted in the inner base, the body includes a straight slot, the rotary tube is fitted over the body, the rotary tube includes a spiral guide slot, the cup is fitted in the body and configured to mount the lipstick, the cup includes a projection received in the straight slot of the body and the spiral guide slot of the rotary tube, and the rotary tube is rotatable to move the cup upwardly and downwardly.

In some embodiments, the telescopic lipstick case further includes a shell fixed to the rotary tube, wherein the shell is configured to rotate the rotary tube.

The foregoing has outlined rather broadly the features and technical advantages of the present disclosure in order that the detailed description of the disclosure that follows may be better understood. Additional features and advantages of the disclosure will be described hereinafter, and form the subject of the claims of the disclosure. It should be appreciated by those skilled in the art that the conception and specific embodiment disclosed may be readily utilized as a basis for modifying or designing other structures or processes for carrying out the same purposes as those of the present disclosure. It should also be realized by those skilled in the art that such equivalent constructions do not depart from the spirit and scope of the disclosure as set forth in the appended claims.

BRIEF DESCRIPTION OF THE DRAWINGS

A more complete understanding of the present disclosure may be derived by referring to the detailed description and claims when considered in connection with the Figures, where like reference numbers refer to similar elements throughout the Figures, and:

DETAILED DESCRIPTION

The following description of the present disclosure accompanies drawings, which are incorporated in and constitute a cosmetic case of this specification, and illustrate embodiments of the disclosure, but the disclosure is not limited to the embodiments. In addition, the following embodiments can be properly integrated to complete another embodiment.

References to "one embodiment," "an embodiment," "exemplary embodiment," "some embodiments," "other embodiments," "another embodiment," etc. indicate that the embodiment(s) of the disclosure so described may include a particular feature, structure, or characteristic, but not every embodiment necessarily includes the particular feature, structure, or characteristic. Further, repeated use of the phrase "in the embodiment" does not necessarily refer to the same embodiment, although it may.

In order to make the present disclosure completely comprehensible, detailed steps and structures are provided in the following description. Obviously, implementation of the present disclosure does not limit special details known by persons skilled in the art. In addition, known structures and steps are not described in detail, so as not to limit the present disclosure unnecessarily. Preferred embodiments of the present disclosure will be described below in detail. However, in addition to the detailed description, the present disclosure may also be widely implemented in other embodiments. The scope of the present disclosure is not limited to the detailed description, and is defined by the claims.

Figure 1A:
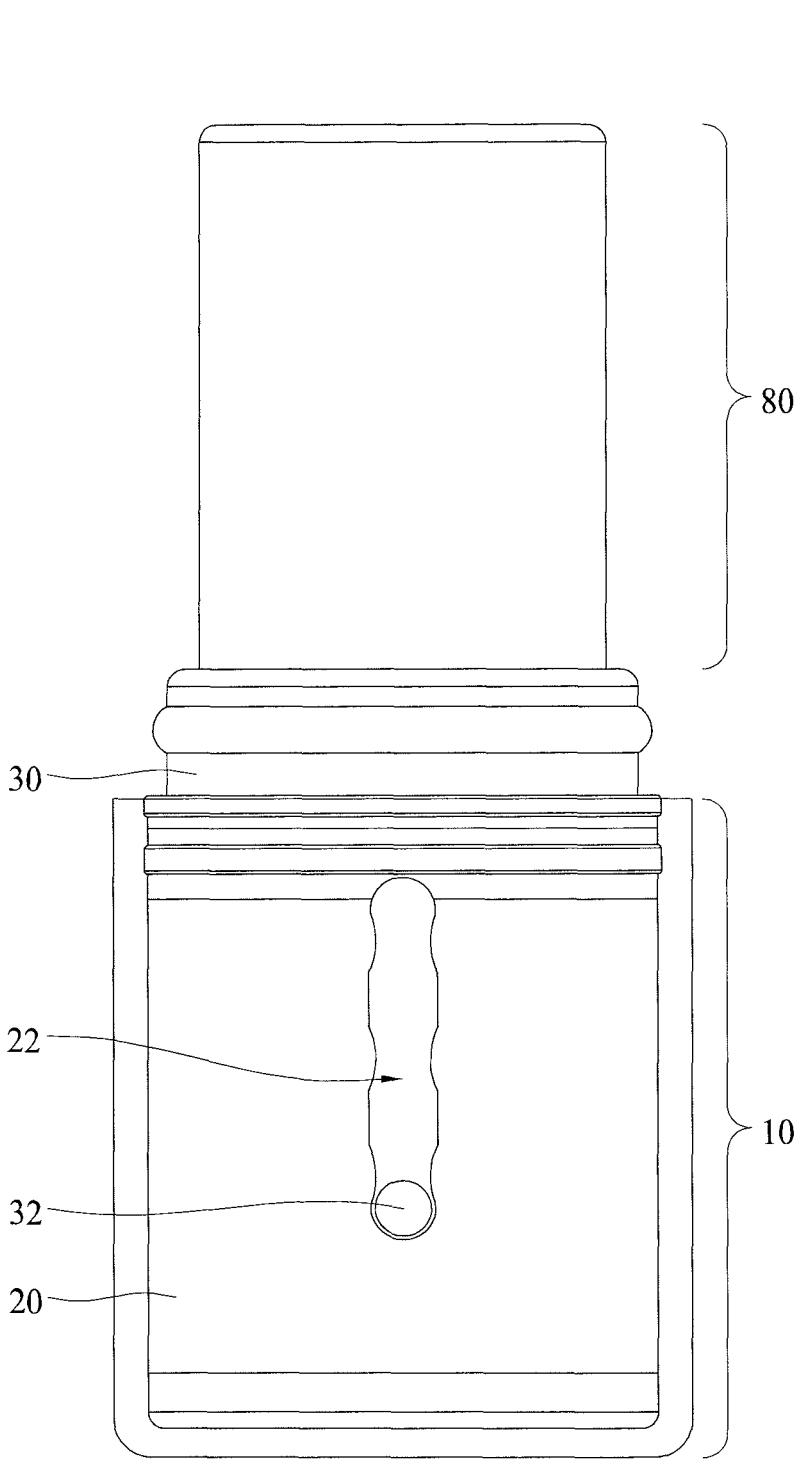
FIG. 1A is a schematic perspective view of a telescopic lipstick case in a retracted state.
Figure 1B:
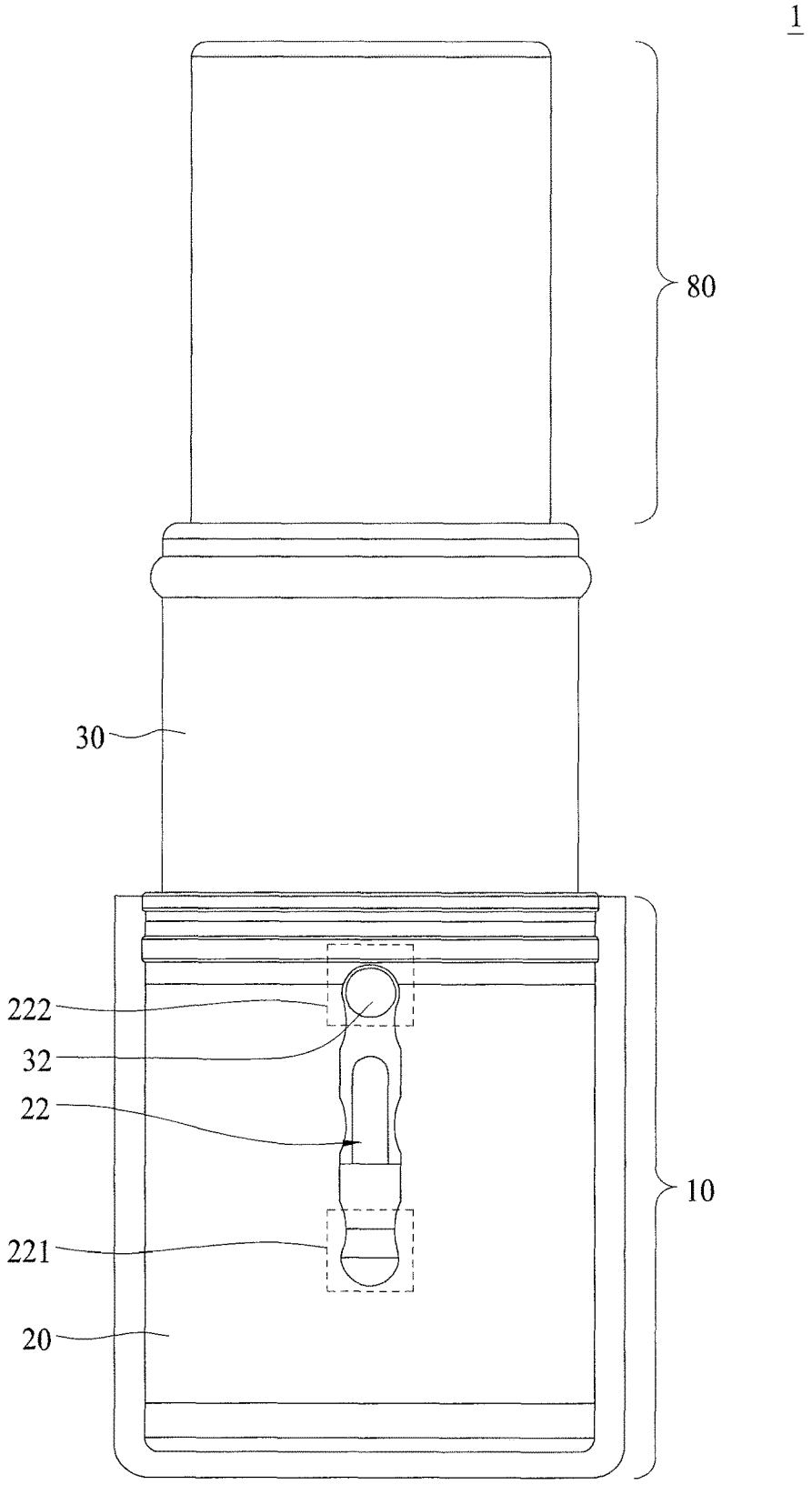
FIG. 1B is a schematic perspective view of a telescopic lipstick case in an extended state.
Figure 2:
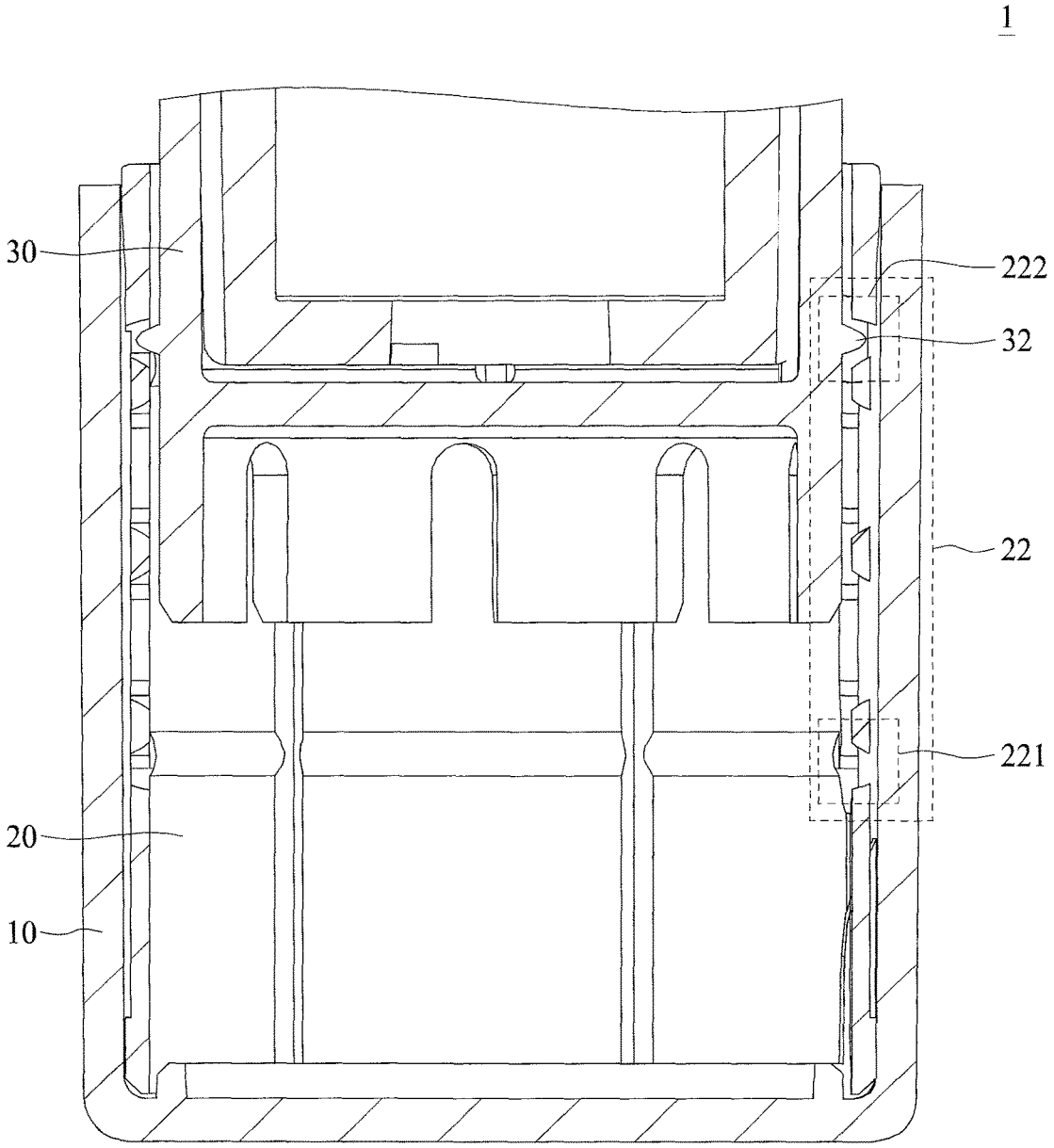
FIG. 2 is an enlarged cross-sectional view of a telescopic lipstick case in accordance with some embodiments of the present disclosure.

Refer to FIG. 1A, FIG. 1B and FIG. 2. FIG. 1A and FIG. 1B are schematic perspective views of a telescopic lipstick case in accordance with some embodiments of the present disclosure, wherein FIG. 1A is a schematic perspective view of a telescopic lipstick case in a retracted state, and FIG. 1B is a schematic perspective view of a telescopic lipstick case in an extended state. FIG. 2 is an enlarged cross-sectional view of a telescopic lipstick case in accordance with some embodiments of the present disclosure. As shown in FIG. 1A, FIG. 1B and FIG. 2, the telescopic lipstick case 1 includes a base 10, an inner body 20 and an inner base 30. In some embodiments, the base 10 may be a barrel-like base. The barrel-like base has a space and an open end defined by a bottom and a sidewall. The inner body 20 is fixed in the space of the base 10, for example, by adhesive or the like. In some embodiments, the inner body 20 may include a tubular base. In some embodiments, the inner base 30 is cylindrically fitted in the inner body 20. In some embodiments, the inner base 30 may include a tubular body. In some embodiments, the inner base 30 is axially movable with respect to the inner body 20 between a first position and a second position.

As shown in FIG. 1A, the inner base 30 may be axially moved downwardly to the first position, at which some part of the inner base 30 is retracted to the inside of the inner body 20. As shown in FIG. 1B and FIG. 2, the inner base 30 may be axially moved upwardly to the second position, at which some part of the inner base 30 is extracted from the inner body 20.

In some embodiments, one of the inner body 20 and the inner base 30 includes a groove, and the other one of the inner body 20 and the inner base 30 includes a protrusion slidably received by the groove. By way of example, the inner body 20 includes a groove 22, and the inner base 30 includes a protrusion 32 received by the groove 22. In some embodiments, the groove 22 of the inner body 20 may be a closed groove, having a first end 221 and a second end 222 arranged in an axial direction. The first end 221 is adjacent to the bottom of the inner body 20, while the second end 222 is adjacent to the top of the inner body 20.

As shown in FIG. 1A, the inner base 30 is downwardly movable with respect to the inner body 20, and the inner base 30 is stoppable at the first position when the protrusion 32 is restrained by the first end 221 of the groove 22. As shown in FIG. 1B and FIG. 2, the inner base 30 is upwardly movable with respect to the inner body 20, and the inner base 30 is stoppable at the second position when the protrusion 32 is restrained by the second end 222 of the groove 22.

In some embodiments, the telescopic lipstick case 1 may further include other elements such as a cap, a body, a rotary tube, a cup and a shell, which will be described in the following embodiments.

In some embodiments, the inner body 20 in association with the inner base 30 provides extending and retracting functions to the telescopic lipstick case 1. When retracted to the retracted state, the telescopic lipstick case 1 is easy to carry. When expanded to the extended state, the telescopic lipstick case 1 is easy to grip.

The telescopic lipstick case of the present disclosure is not limited to the above-mentioned embodiments, and may have other different embodiments. To simplify the description, and for the convenience of comparison between each of the embodiments of the present disclosure, the identical components in each of the following embodiments are marked with identical numerals. In order to facilitate comparing differences between the embodiments, the following description will detail the dissimilarities among different embodiments and the identical features will not be redundantly described.

Figure 3A:
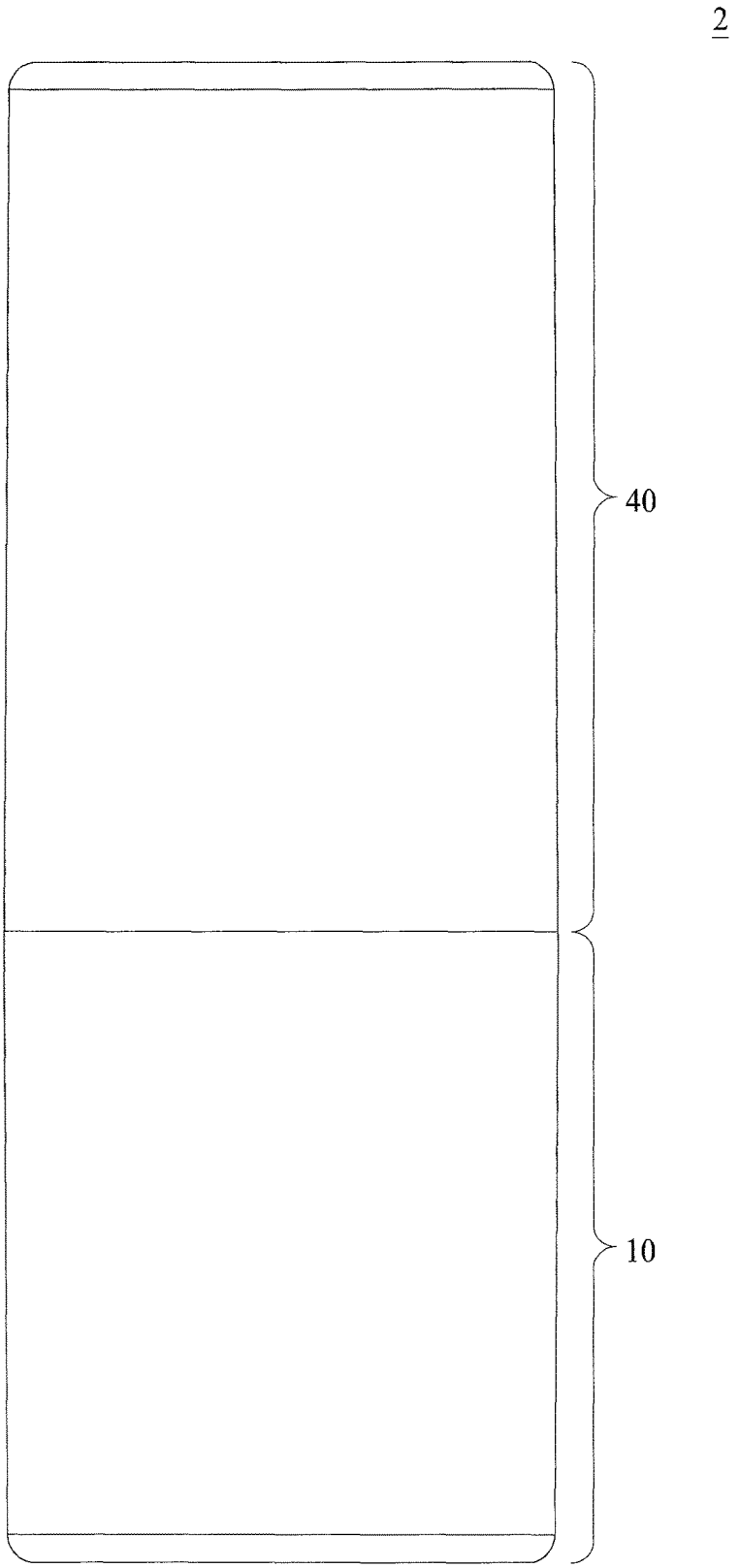
FIG. 3A is a schematic perspective view of a telescopic lipstick case in a retracted state.
Figure 3B:
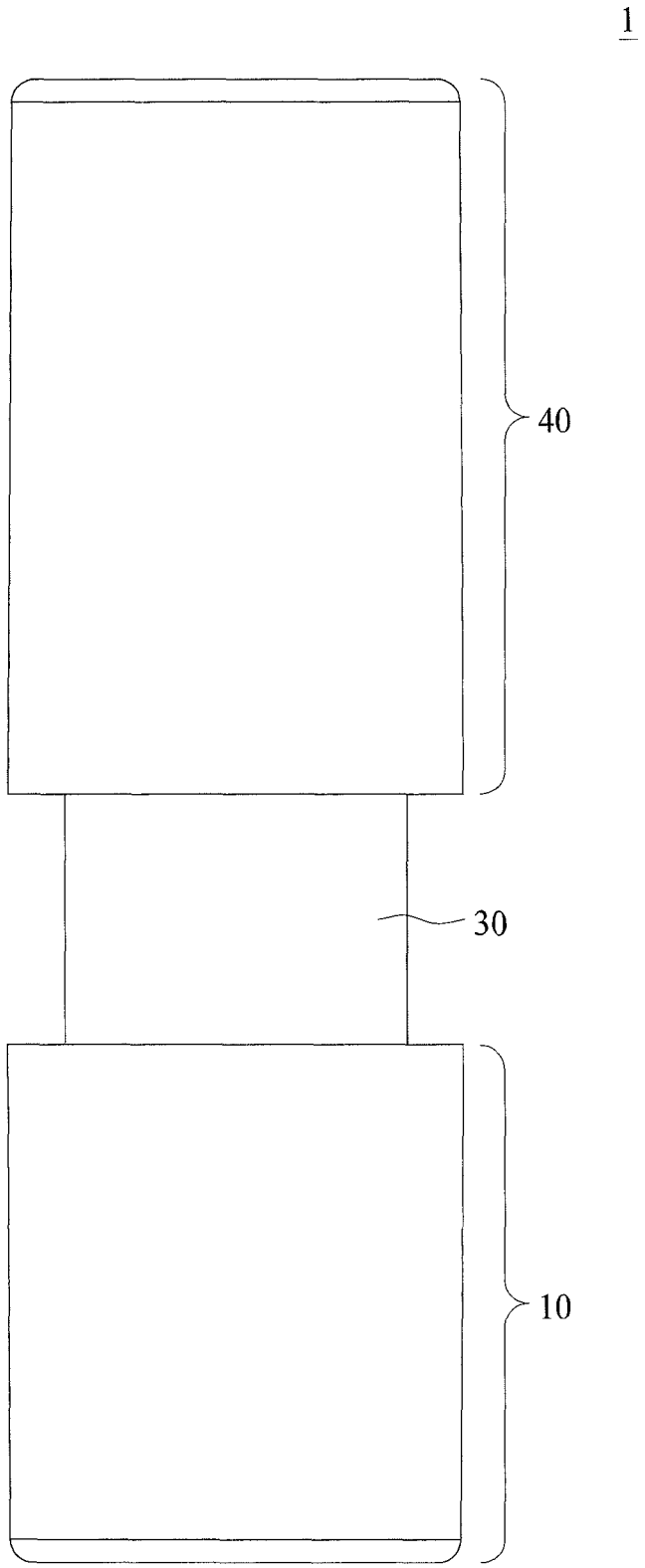
FIG. 3B is a schematic perspective view of a telescopic lipstick case in an extended state.

Refer to FIG. 3A and FIG. 3B. FIG. 3A and FIG. 3B are schematic perspective views of a telescopic lipstick case in accordance with some embodiments of the present disclosure, wherein FIG. 3A is a schematic perspective view of a telescopic lipstick case in a retracted state, and FIG. 3B is a schematic perspective view of a telescopic lipstick case in an extended state. It is understood that some internal components are not shown in FIG. 3A and FIG. 3B to facilitate illustration, but can be seen in FIG. 1A, FIG. 1B, FIG. 2 or other drawings of the present disclosure. As shown in FIG. 3A and FIG. 3B, in contrast to the telescopic lipstick case 1, the telescopic lipstick case 2 may further include a cap 40 configured to cap the base. In some embodiments, the cap 40 may be designed to implement the extending and retracting functions during opening and closing of the telescopic lipstick case 2. By way of example, the inner base 30 may be pushed downwardly by the cap 40 to the first position while closing the cap 40. In other words, the telescopic lipstick case 2 can be automatically switched to the retracted state when the user is done using the lipstick and closes the cap 40 as shown in FIG. 3A. By way of example, the inner base 30 may be pulled upwardly by the cap 40 to the second position while opening the cap 40. In other words, the telescopic lipstick case 2 can be automatically switched to the extended state when the user needs to use the lipstick and opens the cap 40 as shown in FIG. 3B. The example of the linkage mechanism between the cap 40 and the inner base 30 will be described in the following paragraphs.

Refer to FIG. 4A, FIG. 4B, FIG. 5, FIG. 6, FIG. 6A, FIG. 6B, FIG. 7, FIG. 7A, FIG. 7B, FIG. 8, FIG. 8A and FIG. 8B.

Figure 4A:
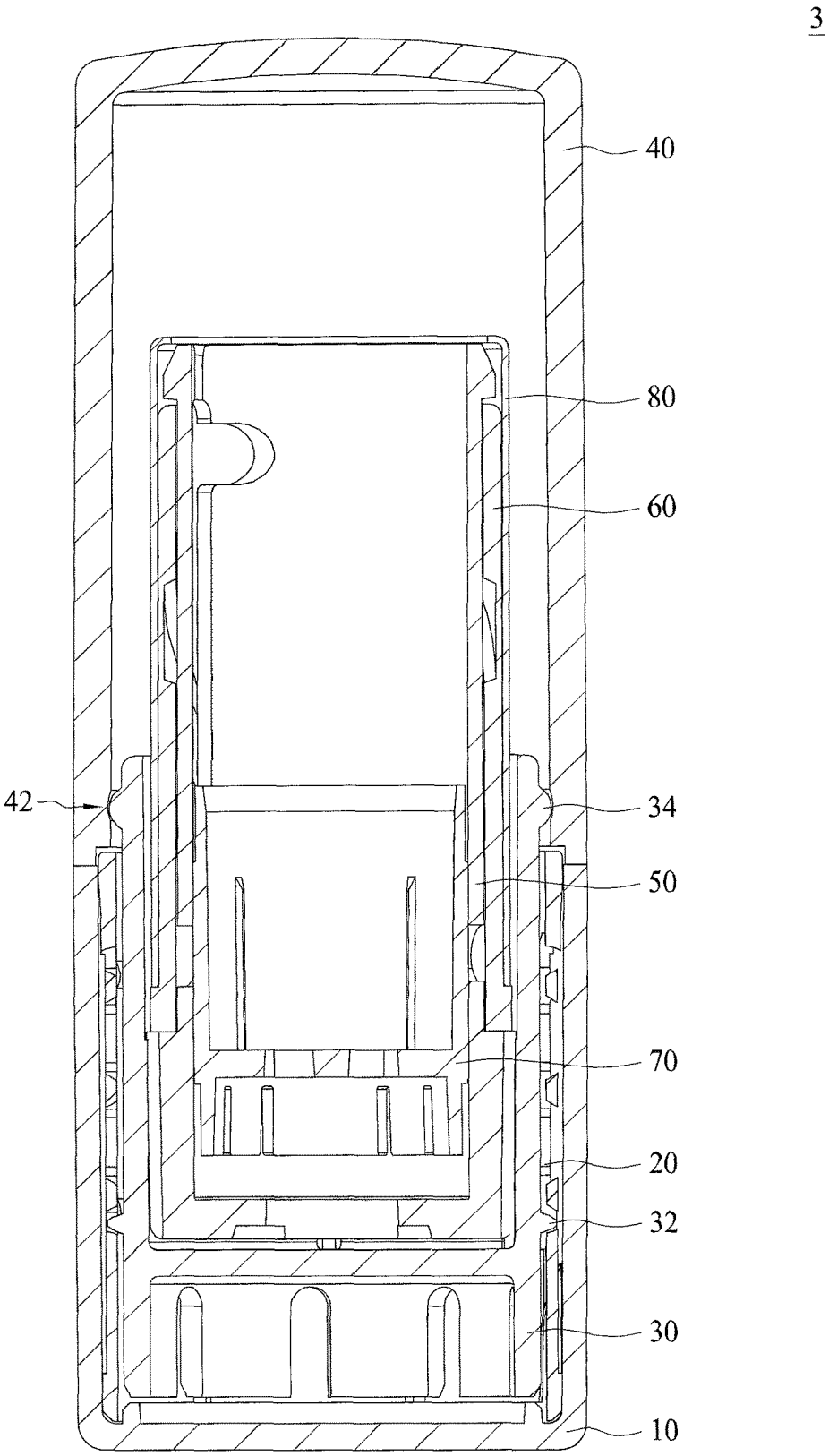
FIG. 4A is a schematic cross-sectional view of a telescopic lipstick case in a retracted state.
Figure 4B:
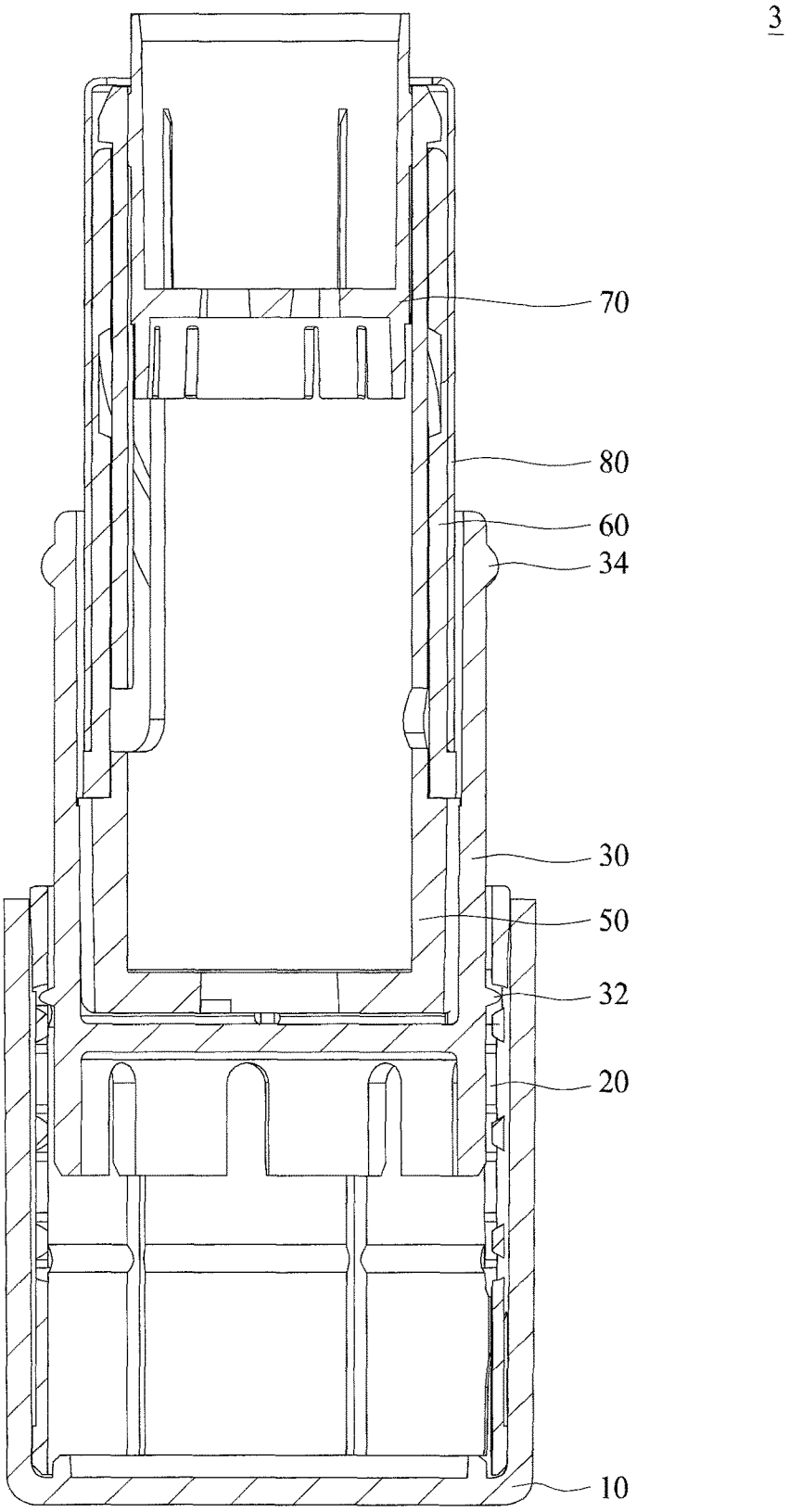
FIG. 4B is a schematic cross-sectional view of a telescopic lipstick case in an extended state.
Figure 5:
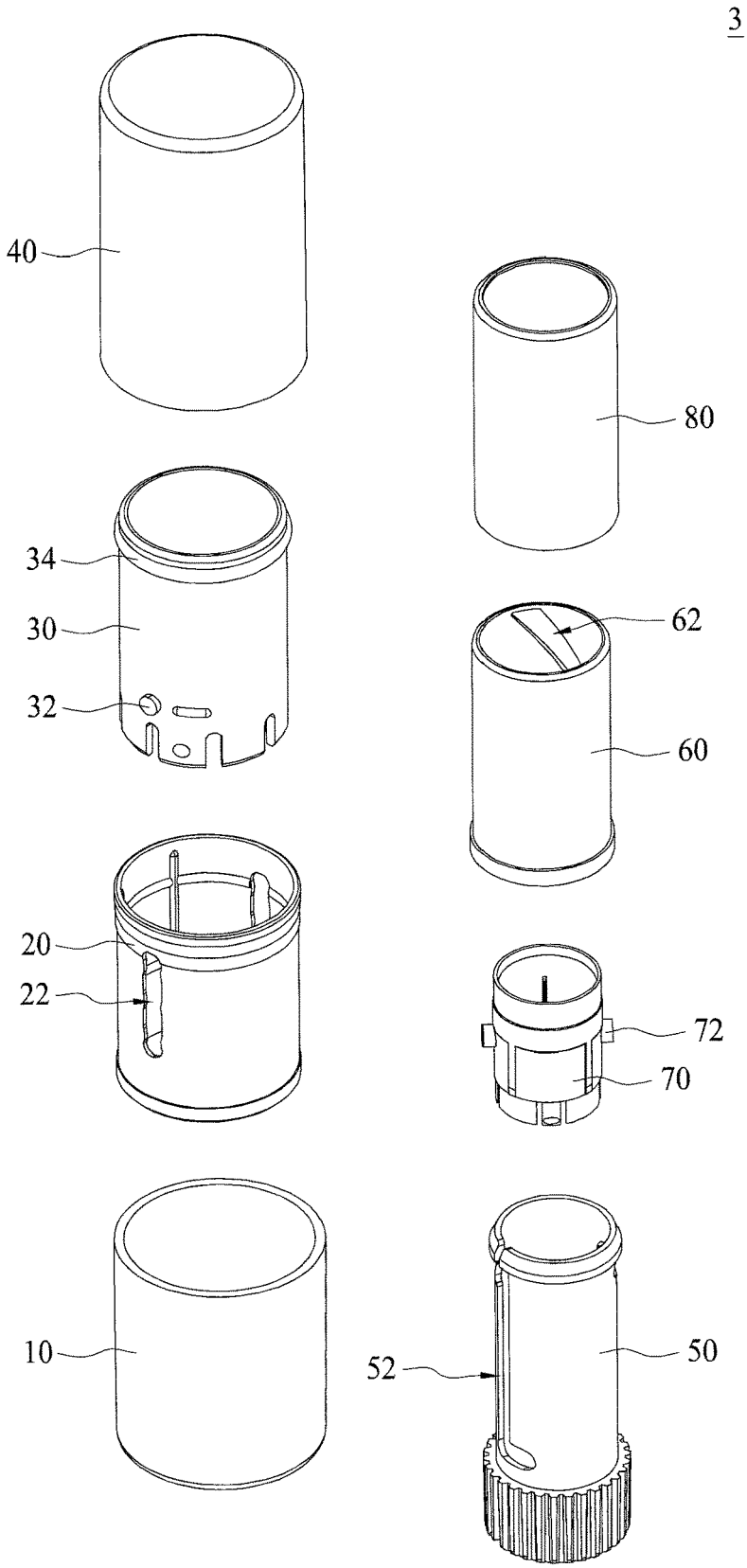
FIG. 5 is a schematic exploded view of a telescopic lipstick case.
Figure 6:
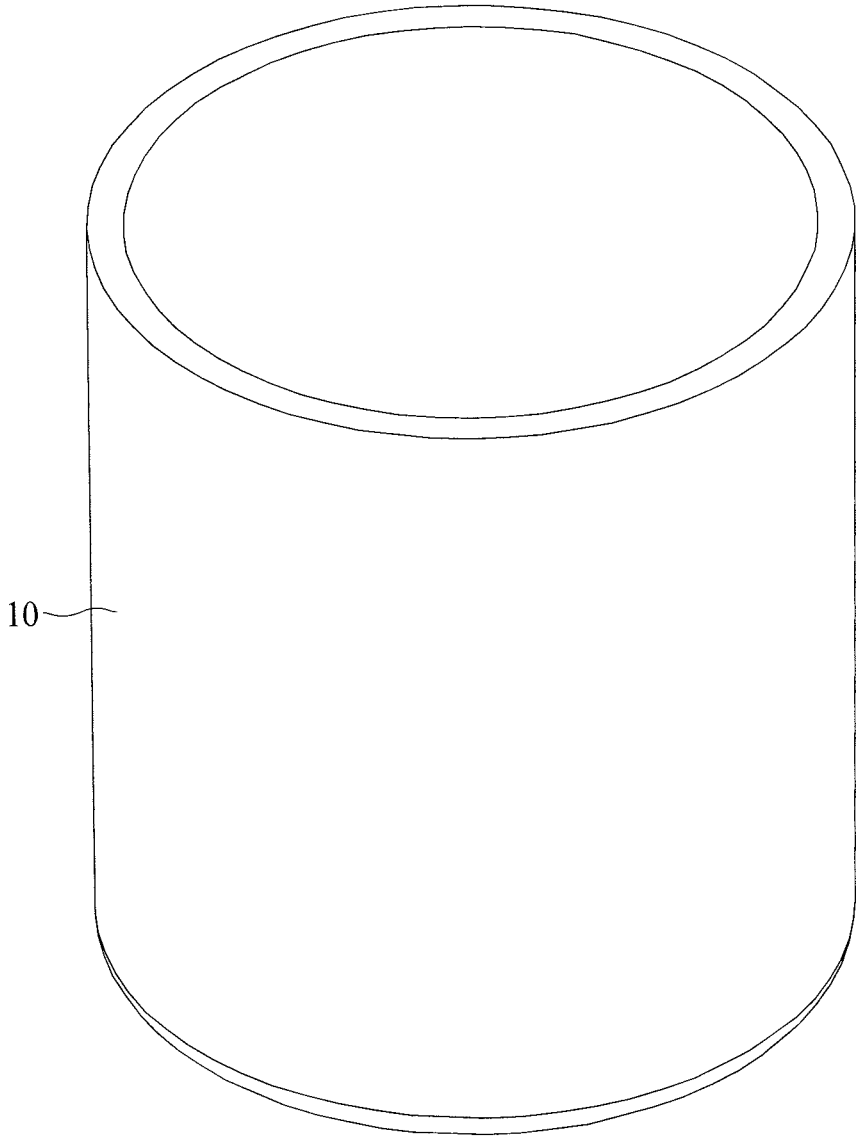
FIG. 6 is a schematic perspective view of a base.
Figure 6A:
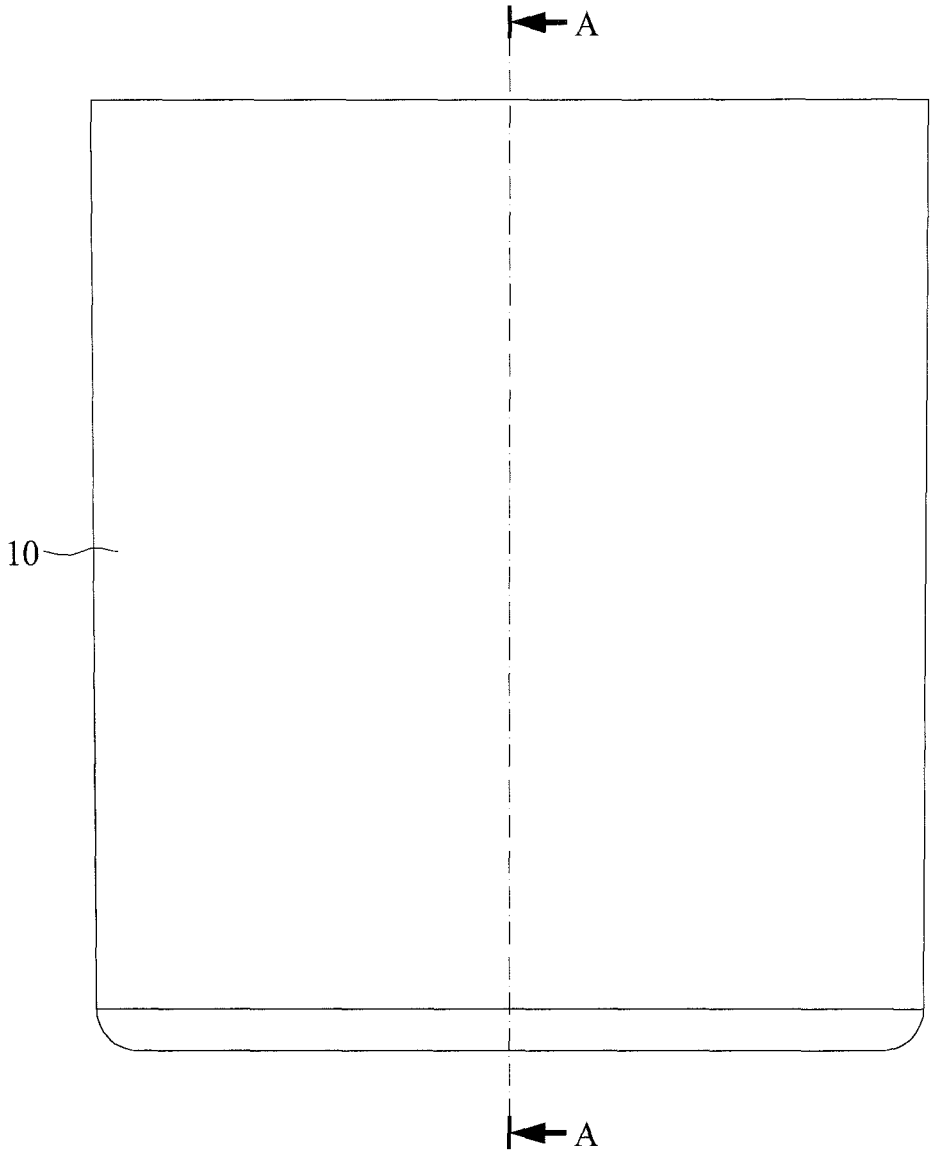
FIG. 6A is a schematic side view of a base.
Figure 6B:
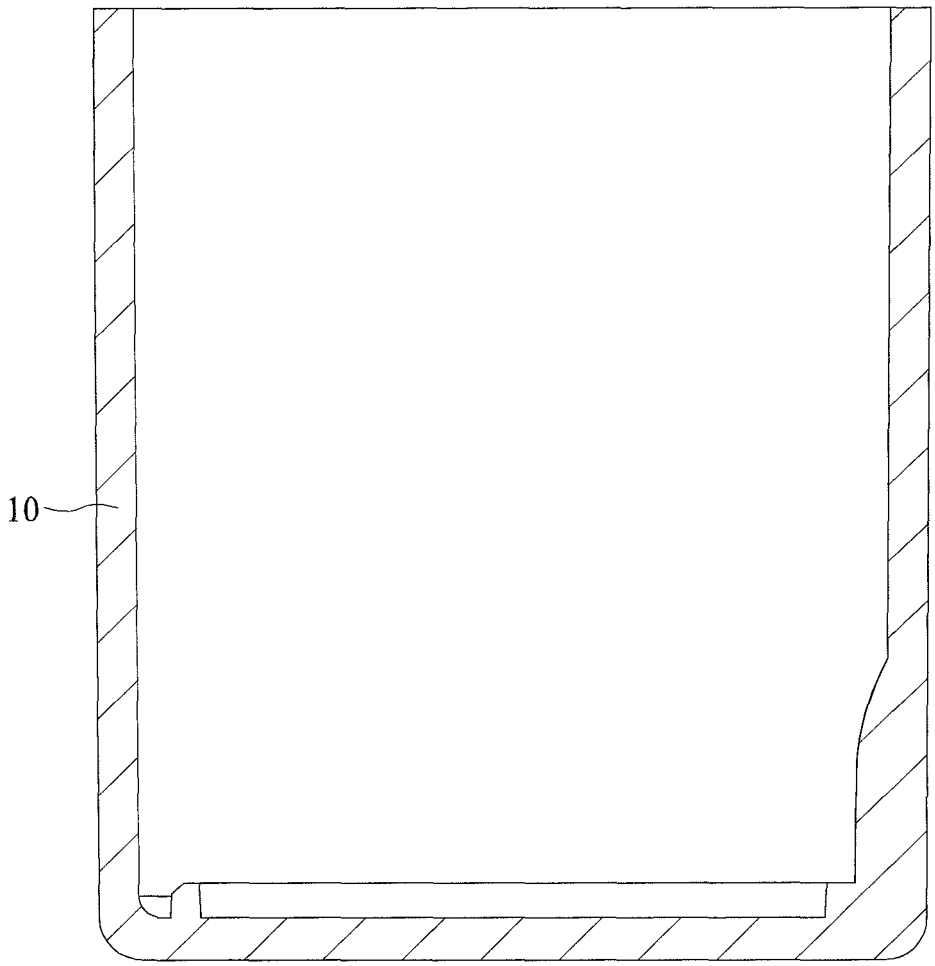
FIG. 6B is a schematic cross-sectional view of a base along a line A-A of FIG. 6A.
Figure 7:
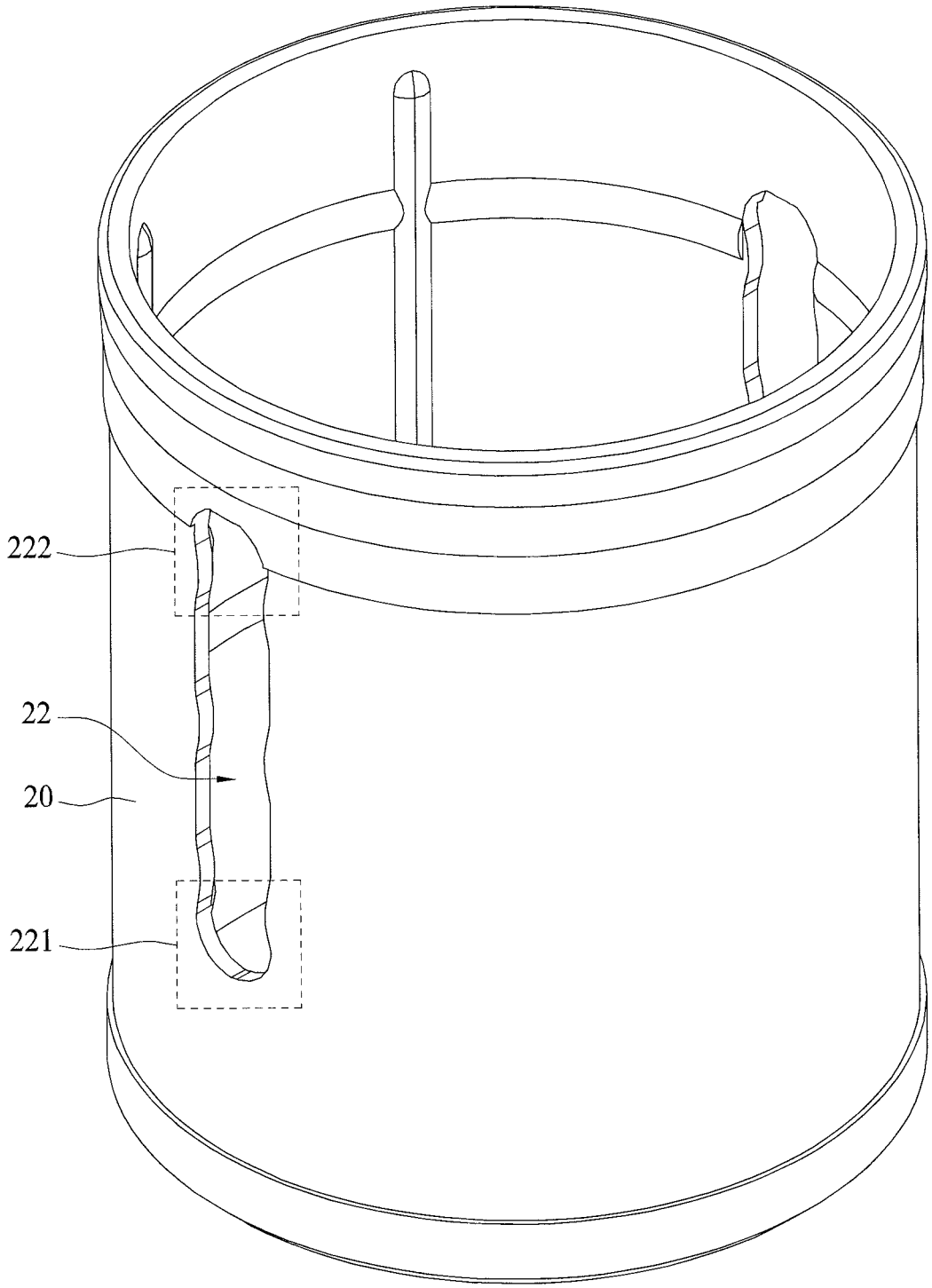
FIG. 7 is a schematic perspective view of an inner body.
Figure 7A:
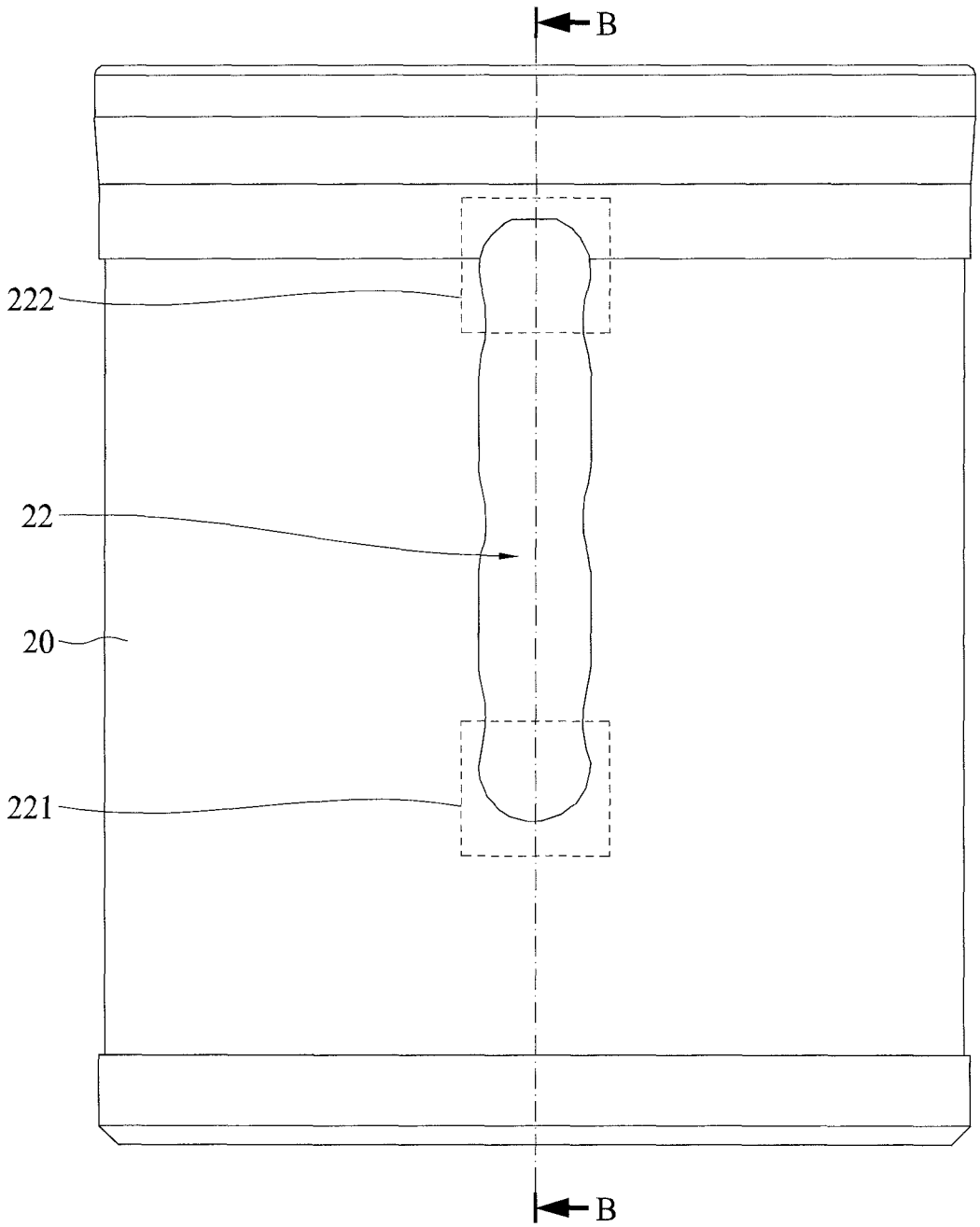
FIG. 7A is a schematic side view of an inner body.
Figure 7B:
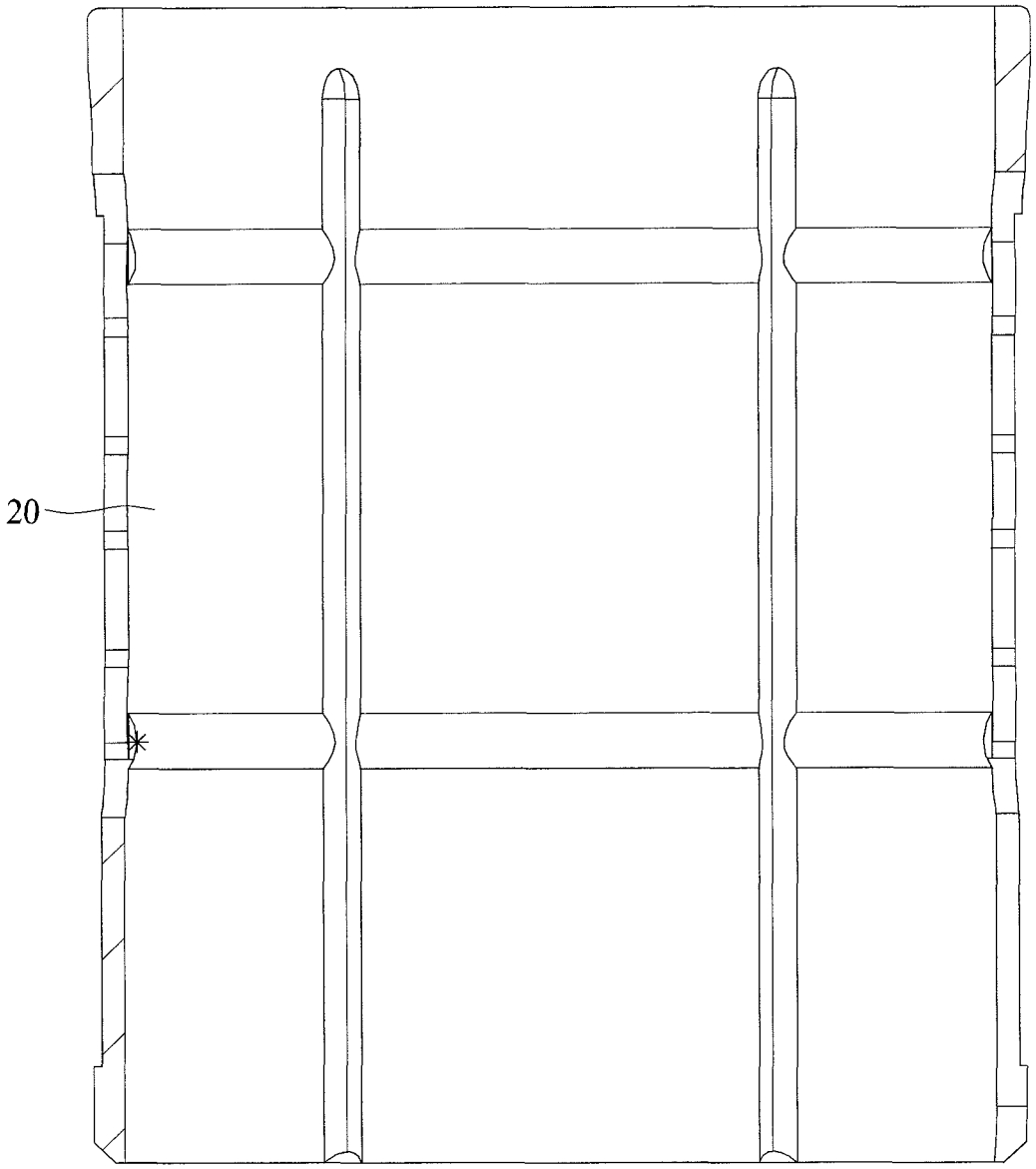
FIG. 7B is a schematic cross-sectional view of an inner body along a line B-B of FIG. 7A.
Figure 8:
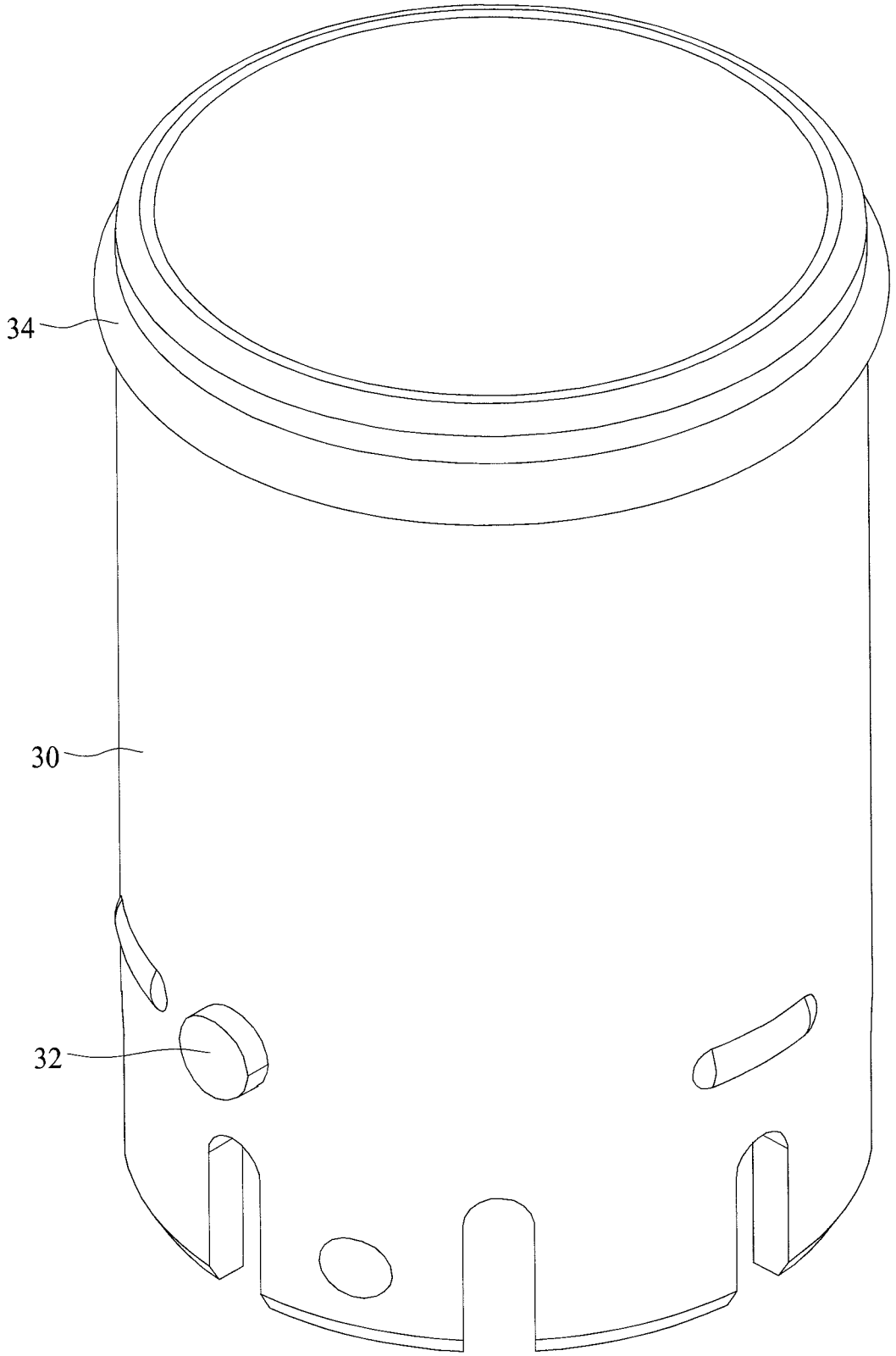
FIG. 8 is a schematic perspective view of an inner base.
Figure 8A:
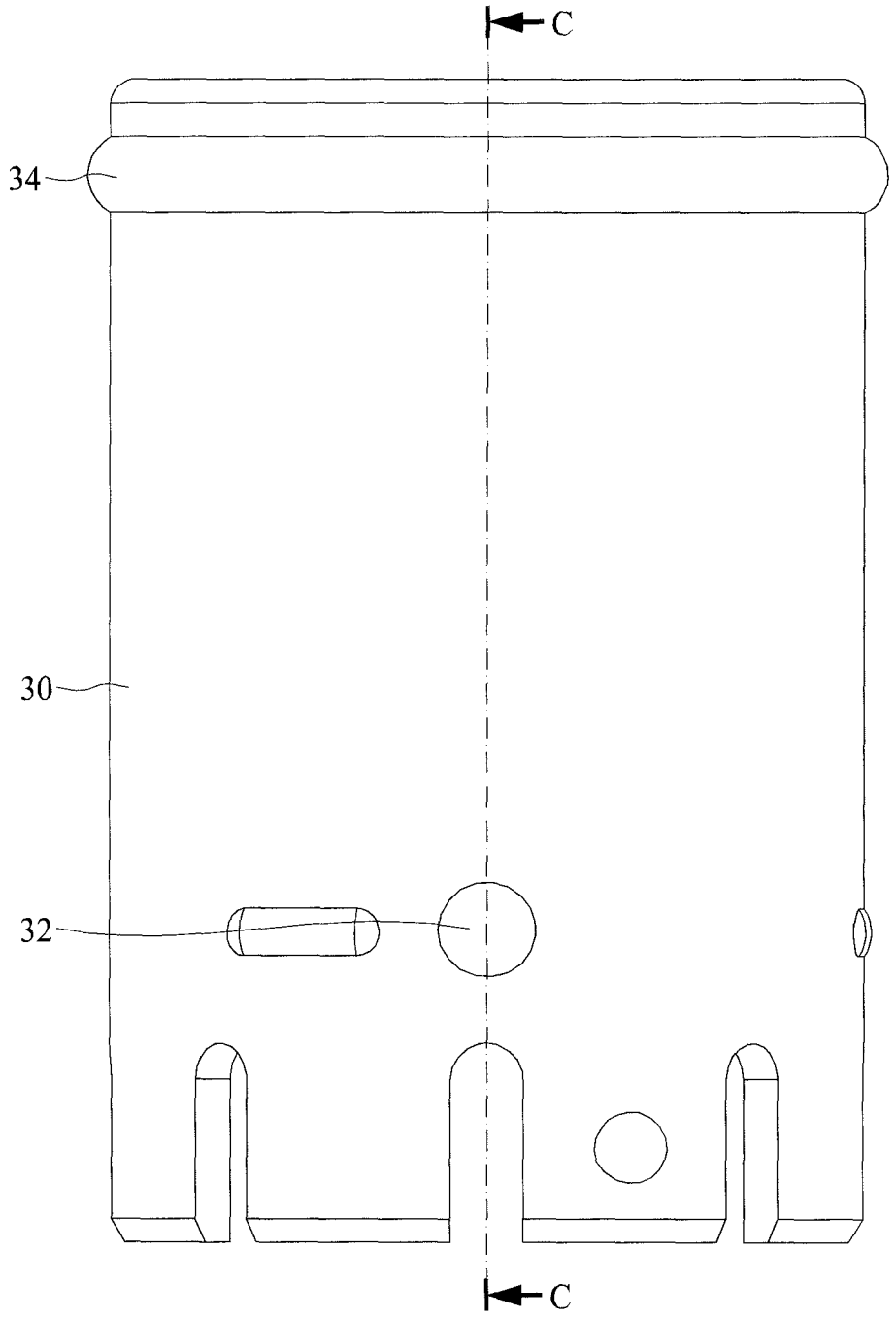
FIG. 8A is a schematic side view of an inner base.
Figure 8B:
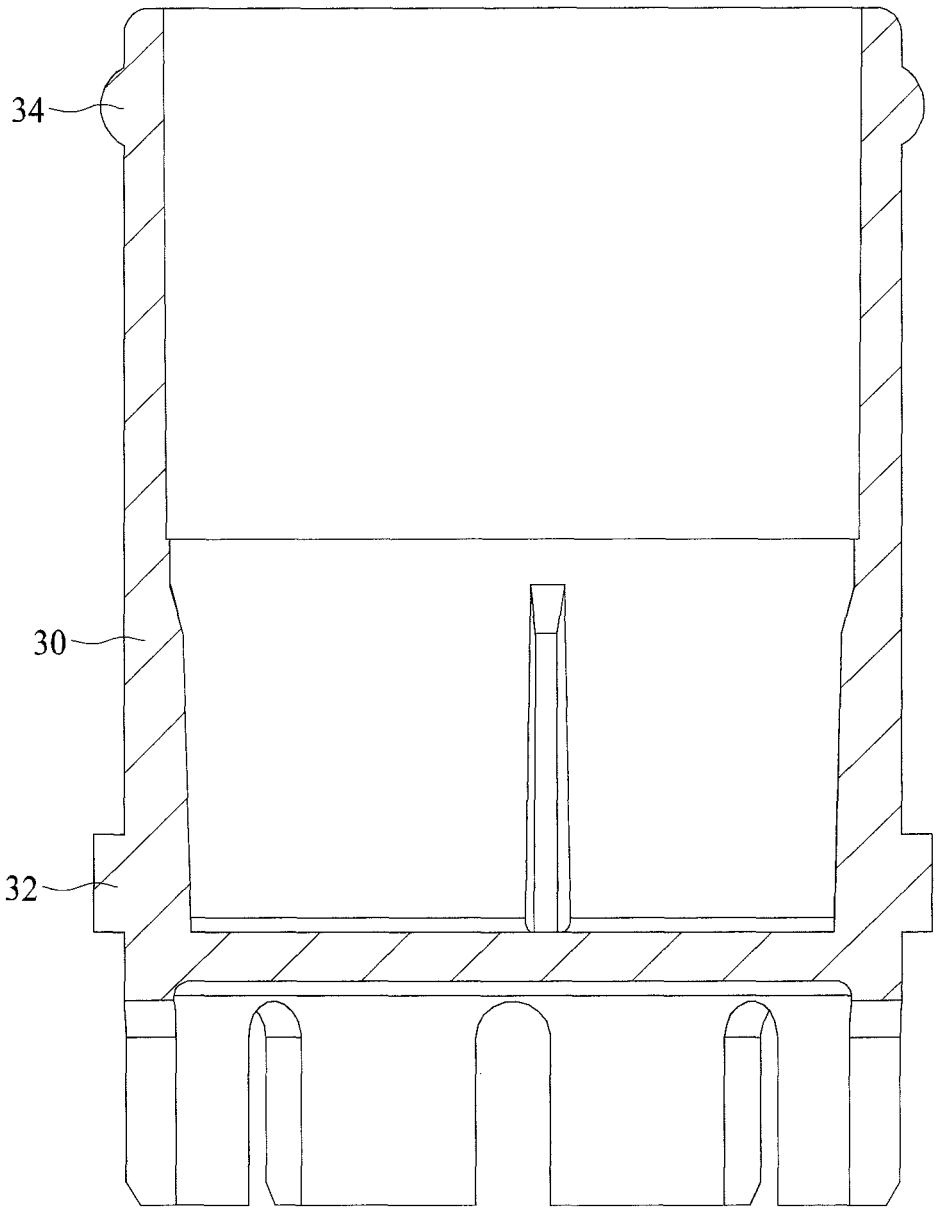
FIG. 8B is a schematic cross-sectional view of an inner base along a line C-C of FIG. 8A.

FIG. 4A, FIG. 4B, FIG. 5, FIG. 6, FIG. 6A, FIG. 6B, FIG. 7, FIG. 7A, FIG. 7B, FIG. 8, FIG. 8A and FIG. 8B are different schematic views of a telescopic lipstick case and components thereof in accordance with some embodiments of the present disclosure. FIG. 4A is a schematic cross-sectional view of a telescopic lipstick case in a retracted state; FIG. 4B is a schematic cross-sectional view of a telescopic lipstick case in an extended state; FIG. 5 is a schematic exploded view of a telescopic lipstick case; FIG. 6 is a schematic perspective view of a base; FIG. 6A is a schematic side view of a base; FIG. 6B is a schematic cross-sectional view of a base along a line A-A of FIG. 6A; FIG. 7 is a schematic perspective view of an inner body; FIG. 7A is a schematic side view of an inner body; FIG. 7B is a schematic cross-sectional view of an inner body along a line B-B of FIG. 7A; FIG. 8 is a schematic perspective view of an inner base; FIG. 8A is a schematic side view of an inner base; and FIG. 8B is a schematic cross-sectional view of an inner base along a line C-C of FIG. 8A.

The telescopic lipstick case 3 includes a base 10, an inner body 20, an inner base 30, a cap 40, a body 50, a rotary tube 60, a cup 70 and a shell 80. In some embodiments, the base 10 may be a barrel-like base. The material of the base 10 may include, but is not limited to, plastic. For example, the material of the base 10 may include metal or other suitable material. The base 10 has a space and an open end defined by a bottom and a sidewall. The inner body 20 is fixed in the space of the base 10, for example, by adhesive or the like. The material of the inner body 20 may include, but is not limited to, plastic. For example, the material of the inner body 20 may include metal or other suitable material. In some embodiments, the inner body 20 includes a groove 22 having a first end 221 and a second end 222 arranged in an axial direction. In some embodiments, the inner base 30 is cylindrically fitted in the inner body 20. The material of the inner base 30 may include, but is not limited to, plastic. For example, the material of the inner base 30 may include metal or other suitable material. In some embodiments, the inner base 30 includes a protrusion 32 received in the groove 22. The inner base 30 is downwardly movable with respect to the inner body 20, and the inner base 30 is stoppable at the first position when the protrusion 32 is restrained by the first end 221 of the groove 22. The inner base 30 is upwardly movable with respect to the inner body 20, and the inner base 30 is stoppable at the second position when the protrusion 32 is restrained by the second end 222 of the groove 22.

In some embodiments, the inner base 30 may further include a bulge 34. By way of example, the bulge 34 may include an annular bulge. The cap 40 is configured to cap the telescopic lipstick case 3. The material of the cap 40 may include, but is not limited to, plastic. For example, the material of the cap 40 may include metal or other suitable material. In some embodiments, the cap 40 may further include a recess 42. By way of example, the recess 42 may include an annular recess. In some embodiments, at least one of the bulge 34 and the cap 40 is resilient such that the bulge 34 is engageable with the recess 42. The recess 42 of the cap 40 may be engageable with the bulge 34 of the inner base 30, in order to fulfill the linkage between the cap 40 and the inner base 30. With the engageable bulge 34 and recess 42, the inner base 30 may be pushed downwardly by the cap 40, and thus the telescopic lipstick case 3 can be automatically switched to the retracted state when the user is done using the lipstick and closes the cap 40. Similarly, with the engageable bulge 34 and recess 42, the inner base 30 may be pulled upwardly by the cap 40 to the second position, and thus the telescopic lipstick case 3 can be automatically switched to the extended state when the user wishes to use the lipstick and opens the cap 40.

In some embodiments, the body 50 can be fitted in the inner base 30. The material of the body 50 may include, but is not limited to, plastic. For example, the material of the body 50 may include metal or other suitable material. In some embodiments, the rotary tube 60 can be fitted over the body 50. The material of the rotary tube 60 may include, but is not limited to, plastic. For example, the material of the rotary tube 60 may include metal or other suitable material. In some embodiments, the cup 70 can be fitted in the body 50 and configured to mount the lipstick. The material of the cup 70 may include, but is not limited to, plastic. For example, the material of the cup 70 may include metal or other suitable material. In some embodiments, the body 50 may include a straight slot 52 arranged along the axial direction. In some embodiments, the rotary tube 60 may include a spiral guide slot 62. In some embodiments, the cup 70 may include a projection 72 received in the straight slot 52 of the body 50 and the spiral guide slot 62 of the rotary tube 60, and the rotary tube 60 is rotatable to move the cup 70 upwardly and downwardly with respect to the body 50. In some embodiments, the shell 80 can be fixed to the rotary tube 60 by adhesive or the like, and the user can rotate the shell 80 to rotate the rotary tube 60 for elevating the cup 70 and the lipstick upwardly. The material of the shell 80 may include, but is not limited to, metal. For example, the material of the shell 80 may include plastic or other suitable material.

In some embodiments of the present disclosure, a telescopic lipstick case switchable between an extended state and a retracted state is provided. The telescopic lipstick case includes an inner base and an inner body having an engageable protrusion and groove design. The engageable protrusion and groove design of the inner base and the inner body provides the telescopic lipstick case with extending and retracting functions, and increases the convenience for the user. For example, the retracting function makes the telescopic lipstick case easy to carry, while the extending function makes the telescopic lipstick case easy to grip when using. The extending and retracting functions can be further implemented during opening and closing the cap. When the user is done using the lipstick and closes the cap, the telescopic lipstick case can be automatically switched to the retracted state. When the user wishes to use the lipstick and opens the cap, the telescopic lipstick case can be automatically switched to the extended state. The linkage between the cap and the inner base makes the use of the telescopic lipstick even more intuitive and user friendly.

Although the present disclosure and its advantages have been described in detail, it should be understood that various changes, substitutions and alterations can be made herein without departing from the spirit and scope of the disclosure as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A telescopic lipstick case for accommodating a lipstick, comprising:

a base;

an inner body fixed in the base;

an inner base cylindrically fitted in the inner body, wherein the inner base is axially movable with respect to the inner body between a first position and a second position; and a cap configured to cap the base;

wherein the inner base includes a bulge, and the cap includes a recess engageable with the bulge of the inner base.

2. The telescopic lipstick case of claim 1, wherein one of the inner body and the inner base includes a groove, and the other one of the inner body and the inner base includes a protrusion slidably received by the groove.

3. The telescopic lipstick case of claim 2, wherein the groove includes a first end and a second end.

4. The telescopic lipstick case of claim 3, wherein the inner base is downwardly movable with respect to the inner body, and the inner base is stoppable at the first position when the protrusion is restrained by the first end of the groove.

5. The telescopic lipstick case of claim 3, wherein the inner base is upwardly movable with respect to the inner body, and the inner base is stoppable at the second position when the protrusion is restrained by the second end of the groove.

6. The telescopic lipstick case of claim 1, wherein the bulge comprises an annular bulge, and the recess comprises an annular recess.

7. The telescopic lipstick case of claim 1, wherein at least one of the bulge and the cap is resilient such that the bulge is engageable with the recess.

8. The telescopic lipstick case of claim 1, wherein the inner base is moved downwardly to the first position by the cap when the cap is pushed in to the inner base.

9. The telescopic lipstick case of claim 1, wherein the inner base is moved upwardly to the second position by the cap when the cap is pulled out from the inner base.

10. The telescopic lipstick case of claim 1, further comprising:

a body fitted in the inner base, wherein the body includes a straight slot;

a rotary tube fitted over the body, wherein the rotary tube includes a spiral guide slot; and a cup fitted in the body and configured to mount the lipstick, wherein the cup includes a projection received in the straight slot of the body and the spiral guide slot of the rotary tube, and the rotary tube is rotatable to move the cup upwardly and downwardly.

11. The telescopic lipstick case of claim 10, further comprising a shell fixed to the rotary tube, and configured to rotate the rotary tube.

* * * * *